US008026781B2

(12) United States Patent
Freakes

(10) Patent No.: US 8,026,781 B2
(45) Date of Patent: Sep. 27, 2011

(54) SOLENOID DEVICE WITH STABLE ACTIVATION

(76) Inventor: Anthony Freakes, Belle Mead, NJ (US)

( * ) Notice: Subject to any disclaimer, the term of this patent is extended or adjusted under 35 U.S.C. 154(b) by 227 days.

(21) Appl. No.: 12/195,676

(22) Filed: Aug. 21, 2008

(65) Prior Publication Data

US 2009/0051472 A1 Feb. 26, 2009

Related U.S. Application Data

(60) Provisional application No. 60/956,981, filed on Aug. 21, 2007.

(51) Int. Cl.
*H01F 7/10* (2006.01)

(52) U.S. Cl. ..... 335/245; 335/247; 335/249; 335/251

(58) Field of Classification Search ..... 335/243–252
See application file for complete search history.

(56) References Cited

U.S. PATENT DOCUMENTS 2,207,082 A 7/1940 Wetzel
2,829,860 A 4/1958 Garner et al.
3,992,687 A 11/1976 Schantz et al.
4,262,877 A 4/1981 Lang
5,578,978 A * 11/1996 Zoerner ..... 335/239
5,893,283 A 4/1999 Evans et al.

FOREIGN PATENT DOCUMENTS

JP 60022305 A * 2/1985

OTHER PUBLICATIONS

International Preliminary Report on Patentability for corresponding PCT application No. PCT/US2008/073837, Feb. 24, 2010. (PCT/IB/326/373/ISA/237).
PCT/ISA/210 & PCT/ISA/237 in PCT/US08/73837, mailed Nov. 4, 2008 (Int'l Search Report & Written Opinion).

* cited by examiner

*Primary Examiner* — Ramon Barrera
(74) *Attorney, Agent, or Firm* — Timothy X. Gibson, Esq.; Gibson & Dernier LLP

(57) ABSTRACT

A solenoid may include a core having a junction surface; a plunger having a junction surface and located adjacent to the core; a shading ring located proximate to an interface between the core junction surface and the plunger junction surface, the shading ring having an outside diameter slightly smaller than the diameter of the core, and operable to produce a concentration of magnetic attraction within an annular range of the interface between a center of the interface and a location of the shading ring; wherein a contact region between the core junction surface and the plunger junction surface is substantially smaller than the respective junction surfaces and located proximate to the annular range of the concentration of magnetic attraction.

13 Claims, 10 Drawing Sheets

SOLENOID DEVICE WITH STABLE ACTIVATION

CROSS-REFERENCE TO RELATED APPLICATIONS

This application claims the benefit of U.S. Provisional Application Ser. No. 60/956,981, filed Aug. 21, 2007, entitled "SOLENOID AND METHOD OF MAKING SAME" the entire disclosure of which is incorporated herein by reference.

BACKGROUND OF THE INVENTION

Solenoids energized by Alternating Current (AC) are notorious for producing objectionable noise. The noise is emitted because the magnetic force holding the solenoid plunger to the core varies from some maximum to zero twice every current cycle. If the current is 60 Hz, then the magnetic force reaches a zero value 120 times per second. This magnetic field and force variation creates conditions which can lead to noise. As the solenoid usually has a return spring, one of the major noise contributors is the tendency of the plunger to leave the surface of the core if the magnetic force drops below the spring force. Then, when the magnetic force rises above the spring force the plunger returns to the core with an impact and some of this energy is converted to audible noise energy. Other noise contributions come from the general instability of the plunger within the vibrating magnetic field. The plunger can move uncontrollably and impact nearby surfaces and make noise as a result.

The solenoid device is well known, and many schemes have been proposed and applied to reduce or remove the noise problem. For example, an old and presently used technique is to use a electrically conductive "shading ring". This is a small secondary single winding in which current flow is induced from the main magnetic field. This current flow produces a small magnetic force that is sufficient to maintain secure contact between the core and plunger against the return spring force during the time that the main magnetic force falls below the spring force.

This scheme works well, but as the force generated by the small current flow in the shading ring is only enough to hold the spring if the plunger and core are kept in intimate contact, and stable, anything that changes the magnetic resistance, such as a small gap between the plunger and core, will render the shading ring ineffective. Consequently, the solenoid will create an undesired buzzing sound.

Also, if a small burr, dent on a contact surface, or debris is present on the mating surfaces of either the plunger or the core, a pivot axis will be created about two points of contact. This allows freedom of movement within the constraint of the guiding tube. Not only does this introduce a gap and lower the permeability of the magnetic circuit, but it allows the magnetic field to move the body of the plunger transversely. This type of magnetic-field-induced buzzing is observed in the absence of a return spring.

In an operating solenoid, if the gap between the core and plunger mating surfaces is sufficient to render the shading ring ineffective against the return spring, and this circumstance is combined with the presence of transverse magnetic field vibrations, the resulting noise and the force of part collisions can be worsened and lead to premature failure of the solenoid.

A low cost of production is needed for solenoids that are constructed for high volume manufacturing and sales. Low-cost construction leads to conditions that promote misalignment, the presence of debris, and low precision. The foregoing conditions can contribute to and/or cause unwanted gaps and noisy operation. So it is not surprising that efforts have been undertaken in the industry to make solenoid construction more precise. However, providing such precision is costly. And although such precision succeeds in producing a higher percentage of quiet solenoids, it does not solve the noise problem completely.

Solenoids serve many markets and end uses. Some require quick response to a signal input and a rapid return from an energized position. In such cases, the coercive force from the retained magnetism must be very low. Such low retained magnetism can be achieved by using magnetic materials in the core and plunger that are soft. Ensuring that the parts stay soft enough, for the desired purpose, during the cold-working of manufacturing is difficult and may require inter-process annealing. Such inter-process annealing increases the cost of production.

Some solenoids are not used where speed of action is important. In these cases, the parts may be harder and increased coercive force may be allowed. However there are limits. Even if it does not matter if a valve shuts several seconds after the power is cut off, it gives the impression of poor control and impending failure. So usually, the return spring force is made sufficient to overcome the coercive force. But this increases the likelihood of generating an undesired buzzing sound, discussed above.

SUMMARY OF THE INVENTION

One embodiment of the present invention may include a low cost solenoid, which cannot be heard in an office sound level environment.

According to one aspect, the invention is directed to a solenoid that may include a core having a junction surface; a plunger having a junction surface and located adjacent to the core; a shading ring located proximate to an interface between the core junction surface and the plunger junction surface, the shading ring having an outside diameter slightly smaller than the diameter of the core, and operable to produce a concentration of magnetic attraction within an annular range of the interface between a center of the interface and a location of the shading ring; wherein a contact region between the core junction surface and the plunger junction surface is substantially smaller than the respective junction surfaces and located proximate to the annular range of the concentration of magnetic attraction.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PREFERRED EMBODIMENTS

In this document, for the purposes of explanation, specific numbers, materials and configurations are set forth in order to provide a thorough understanding of the invention. It will be apparent, however, to one having ordinary skill in the art, that the invention may be practiced without these specific details. In some instances, well known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearance of the phase "in an embodiment" in various places in the specification are not necessarily all referring to the same embodiment.

Figure 1:
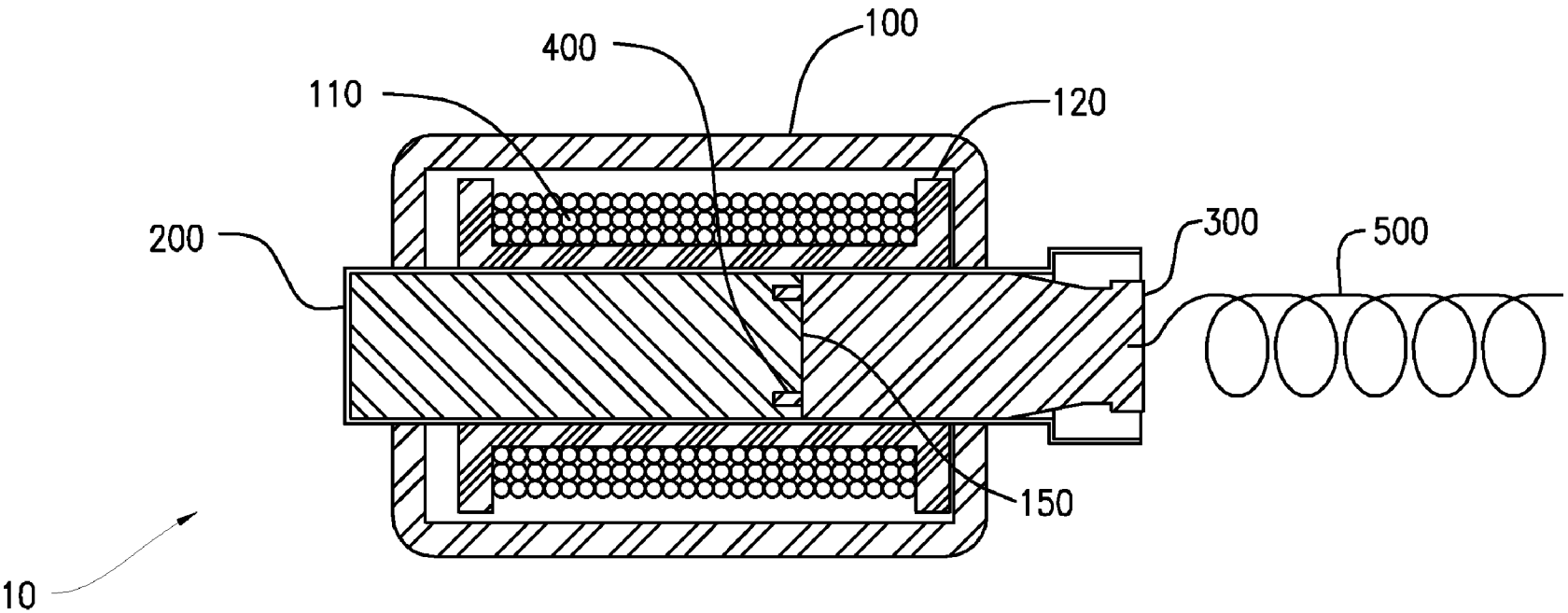
(Prior Art) FIG. 1
FIG. 1 is a cross-sectional view of a solenoid assembly including a core and plunger in accordance with the prior art.

FIG. 1 shows a solenoid assembly 10 that includes enclosure 100, bobbin 120, winding 110, core 200, and plunger 300, and return spring 500. Shading ring 400 is shown embedded within core 200. Interface region 150 is a region at which core 200 and plunger 300 make contact.

Referring to FIG. 1, in the prior art, the junction surface 202 (FIG. 1A) of the core 200 and the junction surface 302 of the plunger 300 are intended to be flat. If surfaces 202, 302 of the core 200 and plunger 300, respectively, were truly flat, the placement of plunger 300 adjacent core 200 would be stable. However, normal low-cost manufacturing methods do not achieve the degree of surface flatness needed to provide a high level of stability for plunger 300.

The surface characteristics of parts faced in a lathe depend on the perpendicularity of the cross slide to the turning axis of the lathe, and this perpendicularity is never perfect. Even if a lathe were initially produced with perfect slide perpendicularity, the lathe would experience a progressively increasing loss of perpendicularity from temperature variations and wear under normal operating conditions. Moreover, the lathe cutting tool is subject to varying speeds, cutting forces, lubricity, and vibrations which tend to divert the cutting tool from its intended path. Additionally, facing cuts can cause the part to deflect and cause departure from an optimal true cutting path of the cutting tool with respect to the part. Thus, perfect flatness is unattainable in parts that are turned in a lathe. Turned parts therefore exhibit either concave or convex conical facing. This situation can lead to four possible combinations of surface types between two separately turned faces, as discussed below.

Surface Match Types:

1. Convex surface to convex surface with contact at the center. (FIG. 1A)
2. Concave surface to concave surface with contact at the periphery. (FIG. 1B)
3. Convex surface to concave surface with contact at the center.
4. Convex surface to concave surface with contact at the periphery.

Figure 1B:
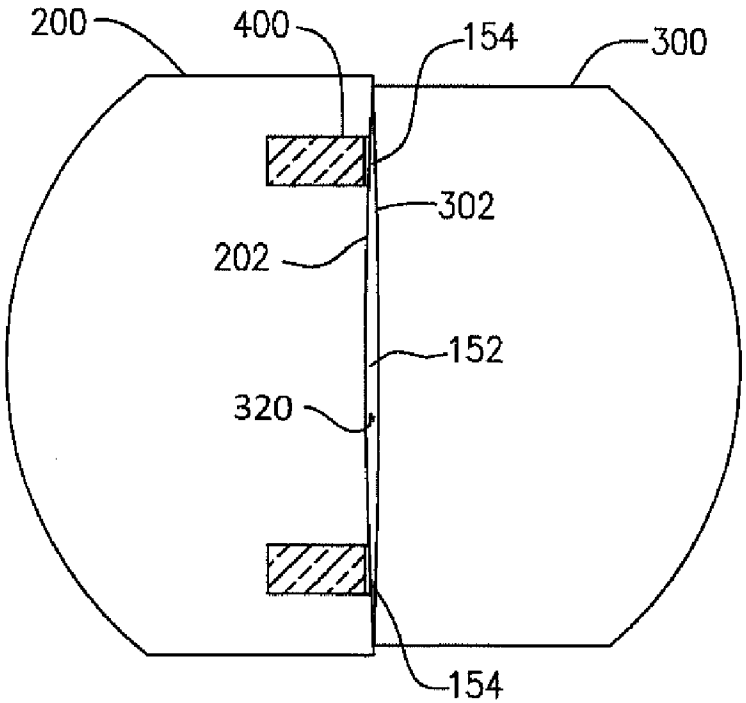
FIG. 1B is a sectional view of a core and the plunger of the solenoid in accordance with the prior art.
Figure 1A:
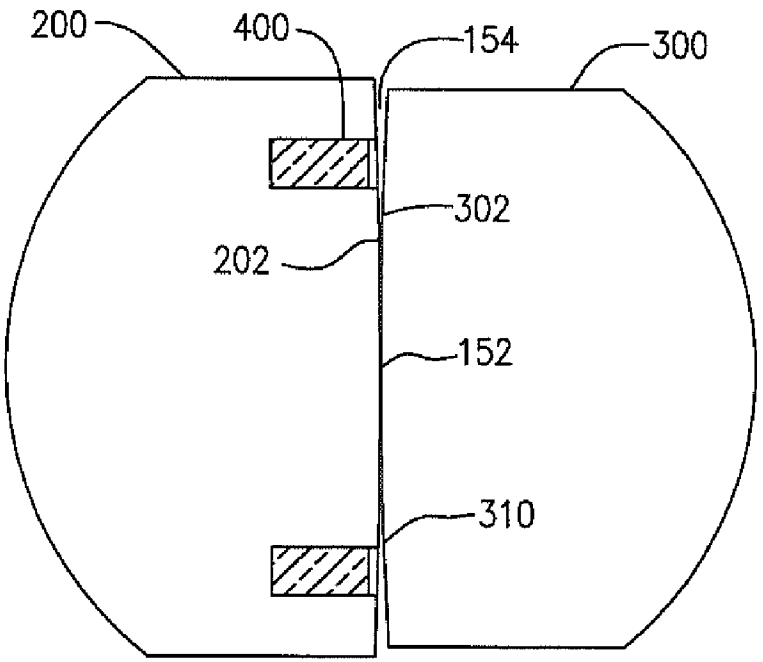
FIG. 1A is a sectional view of a core and plunger of in accordance with the prior art.

FIG. 1A is a sectional view of a core 200 having a convex junction surface 202 joined with a plunger 300 having a convex junction surface 302. Thus, in the arrangement of FIG. 1A, contact between junction surfaces 202 and 302 occurs at the center 152 of interface region 150 (FIG. 1). At the periphery 154 of interface region 150, gap 310 tends to result in a low level of force holding core 200 and plunger 300 together and resulting instability. Thus, core 200 and plunger 300 combinations with contact substantially only at the center 152 (FIG. 1A) of interface region 150 would make the core/plunger contact unstable.

FIG. 1B is a sectional view of a core 200 having a concave junction surface 202 joined with a plunger 300 having a concave junction surface 302. Thus, in the arrangement of FIG. 1B, contact between junction surfaces 202 and 302 occurs at the periphery 154 of interface region 150 (FIG. 1). The core 200 and plunger 300 of FIG. 1B experience contact at their respective peripheries as shown in FIG. 1B. A gap 320 exists at and near the center 152 of interface region 150.

The conditions shown in FIG. 1A and FIG. 1B both tend to produce buzzing as vibration occurs at the interface 150 of core 200 and plunger 300. In the configuration of FIG. 1A, the buzzing would be due to instability, and in the configuration of FIG. 1B, the buzzing would be due to a loss of magnetic permeability.

The deviation from flatness of the junction surfaces 202, 302 in FIGS. 1A and 1B is additive and will lead to troublesome instability and loss of permeability. The deviation from flatness in the match types 3 and 4 (of the four match types listed above) is subtractive and in some cases results in so small an instability or loss of permeability that buzzing is diminished to an acceptable level.

The inventor's data shows that in a normal manufacturing environment, over 50% of solenoids with flat turned core and plunger faces initially experiencing buzzing at the core-plunger interface 150. However, the inventor's data also shows that after some rework of the faces is performed, and after selective assembly is conducted, the buzzing may be reduced. *However, it seems the best that can be achieved with careful and expensive rework is a final buzz rate of* 5%, which remains unacceptable.

Techniques for reducing the expensive rework, such as requiring that controlled batches of core 200 and plunger 300 faces be machined on the same machine cross slide would eliminate the situations faced in surface match types 1 and 2 in the above list. However, the special process control of the parts needed for this approach may make such techniques as expensive as re-working the parts, and thus still provides an undesirable solution.

Moreover, the above approaches to avoiding buzzing may be thwarted by circumstances encountered during shipping and/or within a working environment. After shipping from the factory, the solenoid experiences vibration during shipping and is subsequently installed in a work environment. Thereafter, if any event creates misalignment between parts within the solenoid, such as debris entering the core chamber, undesired buzzing may occur.

Since an appreciation of the characteristics of magnetic flux is beneficial to an understanding of various embodiments of the invention, a discussion of theory is provided below, prior to describing applications thereof in various embodiments of the invention. AC electrical current and the attendant eddy currents cause the magnetic flux to not be evenly distributed in the ferric core of the solenoid. It tends to be stronger at the outside and weakest at the center. Applying this principle to the shading ring center pole, there would generally be more magnetic force near the outer diameter of this pole than at the center of the core 200.

Figure 2:
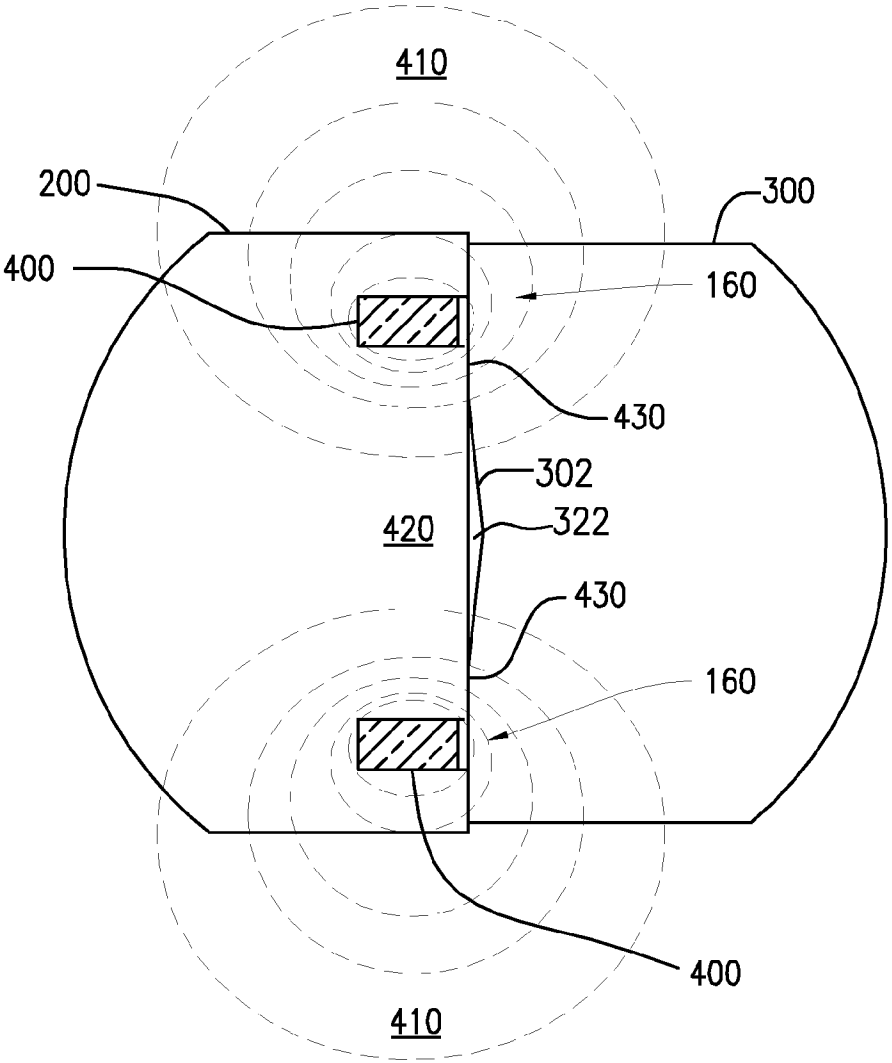
FIG. 2 is a sectional view of a core and plunger of a solenoid in accordance with an embodiment of the present invention.
Figure 2B:
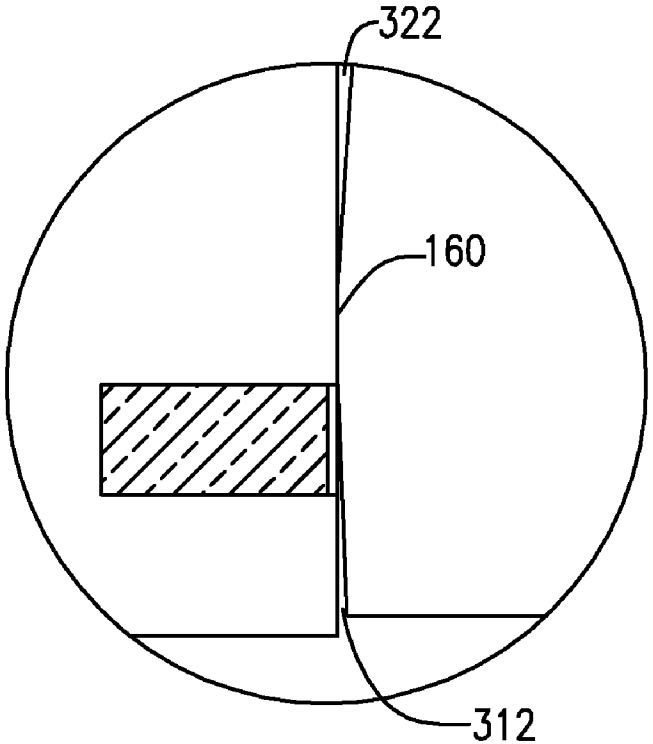
FIG. 2B is an expanded view of the encircled portion of FIG. 2A.

FIG. 2 shows the concentration of magnetic attraction 430 caused by shading ring 400 and occurring at center pole 420. The passage of current through shading ring 400 (shown in cross-section in FIG. 2) produces two magnetic poles: a center pole 420 and an outer pole 410. The outer pole 410 is located outside the diameter of the shading ring 400. The shading ring 400 center pole 420 is preferably located in the region of the core 200 that is surrounded by the shading ring 400.

Similar to the above current discussion, passage of current through the shading ring 400 will tend to produce a center pole 420 within an interior diameter of the shading ring 400 regardless of which device, or devices, the shading ring is embedded in. In the case of FIG. 2, the shading ring 400 and its center pole 420 are disposed in the core 200. However, in other embodiments, the shading ring 400 and its center pole 420 could be disposed in one or more other devices in place of, or in addition to, the core 200, such as but not limited to plunger 300.

In the embodiment of FIG. 2, the junction surface 302 of plunger 300 is not flat. Instead, plunger junction surface 302 includes a shallow concave cone 322 located substantially at the center of plunger junction surface 302. Cone 322 preferably has an outside diameter that is less than the outside diameter of the shading ring central pole 420.

The deployment of cone 322 preferably has the effect of creating an annular contact region 160 within interface region 150 between core 200 and plunger 300 that is located proximate to the concentration of magnetic attraction 430 near the outer diameter of center pole 420 of shading ring 400. More specifically, in this embodiment, the annular contact region 160 may extend from the outer diameter of cone 322 to the outer diameter of the narrower one of plunger 300 and core 200. In other embodiments annular contact region 160 may extend from the outer diameter of cone 322 to the inner diameter of the shading ring 400. The center 162 of contact region 160 along the radial axis of the interface between junction surfaces 202 and 302, according to one embodiment, is indicated by a dashed line in FIG. 2A. This radial position is referred to herein as the annular contact region center 162 or annular contact region center radius 162.

The proximity of contact region 160 to the high flux concentration zone 430 at the outer part of the shading ring center pole 420 improves the operation of shading ring 400, thereby strengthening the magnetic force holding core 200 and plunger 300. This improved magnetic force thus more effectively resists the force of return spring 500 (FIG. 1) and provides greater stability for plunger 300.

Cone 322 of FIG. 2 is distinguishable from gap 320 shown in FIG. 1B. Gap 320 of FIG. 1B is an unintended consequence of arising from the random occurrence of concavity in the junction surfaces of 202, 302 of core 200 and plunger 300 respectively. Gap 320 generally diminishes the effectiveness of the magnetic force of shading ring 400. In contrast, cone 322 is preferably deliberately introduced into plunger 300 and is preferably dimensioned so as to enhance the magnetic attractive force imparted by shading ring 400 to contact region 160 between core 200 and plunger 300. In alternative embodiments, a cone, such as concave cone 322, is not limited to be being located in plunger 300, but could be located in core 200, plunger 300, or both core 200 and plunger 300.

One property of solenoids beneficial for various embodiments of the invention is that once electric power to the core 200 of solenoid 10 is removed, the eddy currents cease, and retained magnetism is no longer forced to concentrate at the outer parts of the core, but tends to disperse evenly across the core's cross section.

To benefit from the above-described property of AC solenoids, an embodiment of the present invention allows the use of core 200 and plunger 300 materials that have a higher coercive force property. The cone 322 at the center of the interface 150 between the core 200 and plunger 300 mating surfaces 202, 302 preferably serves to reduce the effect of the retained magnetism and thus preferably allows the return spring 500 to easily move the plunger away from the core.

Figure 2A:
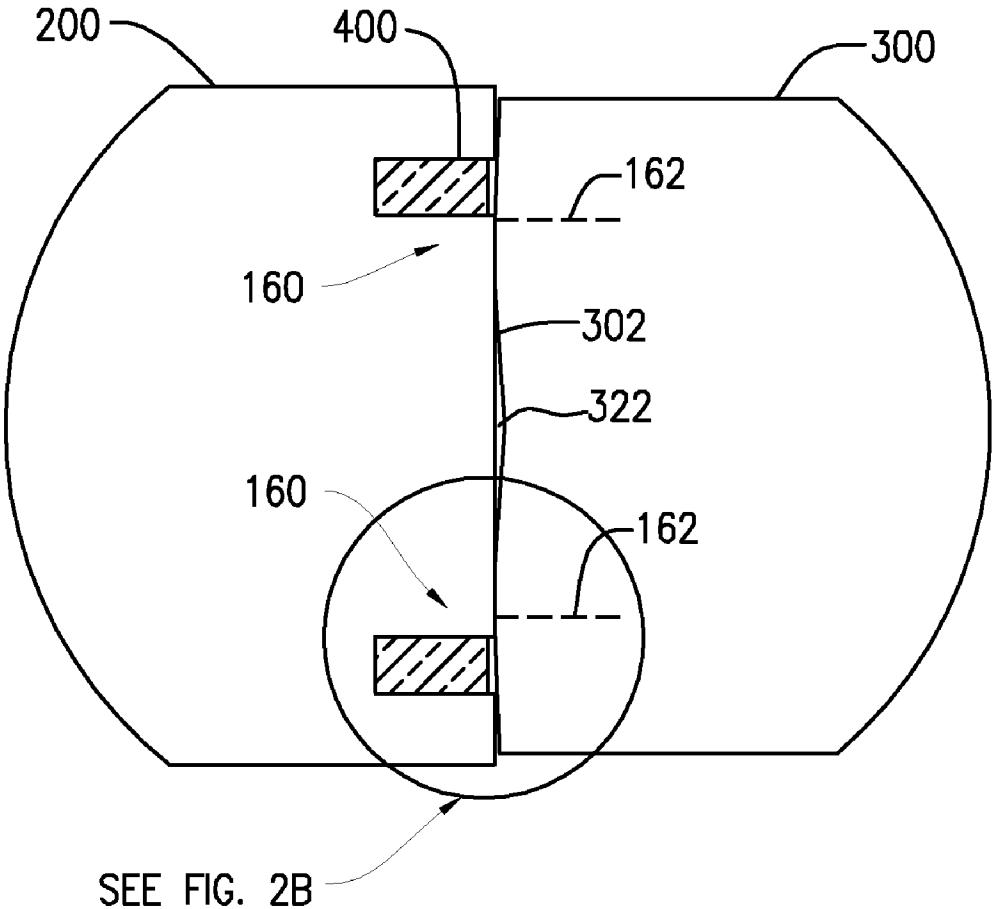
FIG. 2A is a sectional view of a core and plunger of a solenoid, in accordance with another embodiment of the present invention.

FIG. 2A shows the interface between a core 200 and a plunger 300 that includes a cone shaped concavity 322 within junction surface 302 of plunger 300 and a relief 312 about the perimeter of plunger 300.

In the embodiment of FIG. 2A, a relief 312 is provided along the perimeter of plunger 300, thereby preventing contact between plunger 300 and core 200 within the annular region of the relief 312. In one embodiment, the relief angle may be about two degrees with respect to the plane of the interface between core 200 and plunger 300. However, in other embodiments, the relief angle may be greater than or less than two degrees.

Providing relief 312 may further improve the concentration of magnetic attraction force by reducing the size of contact region 160 in comparison to that provided by the embodiment of FIG. 2. As discussed earlier herein, providing concave cone 322 operates to reduce the surface area of contact region 160 by reducing the radial range of the annular region over which core 200 and plunger 300 make contact with one another. Providing relief 312 in combination with concave cone 322 further reduces the radial range of the annular contact region 160, thereby concentrating the magnetic force from shading ring 400 within an even smaller surface contact region 160. As with the concavity discussed in connection with FIG. 2, relief around the periphery of interface region 150 may be provided on plunger 300, as shown in FIG. 2A, on core 200 (as shown in FIG. 3), or on both plunger 300 and core 200.

In comparison with existing systems, the embodiment of FIG. 2A provides an increased ability to function even if debris is present at or near the interface 150 between core 200 and plunger 300. First, small amounts of debris material are more likely to be located in the gaps forming part of relief 312, or in the central cavity 322 than within contact region 160. Second, even if the debris is large enough to disrupt direct physical contact between plunger 300 and core 200, or if the debris is unfortunately located within the annular contact region 160, the resulting gap will still have a smaller effect on the magnetic permeability of the embodiment of FIG. 2A than a similar amount of debris would have if such debris were located between a flat-surfaced plunger and a flat-surfaced core of the prior art.

Further, the embodiment of FIG. 2A makes it much more likely that direct physical contact will exist between core 200 and plunger 300 where the magnetic attraction generated by shading ring 400 is greatest, even in the presence of some degree of misalignment.

Figure 3B:
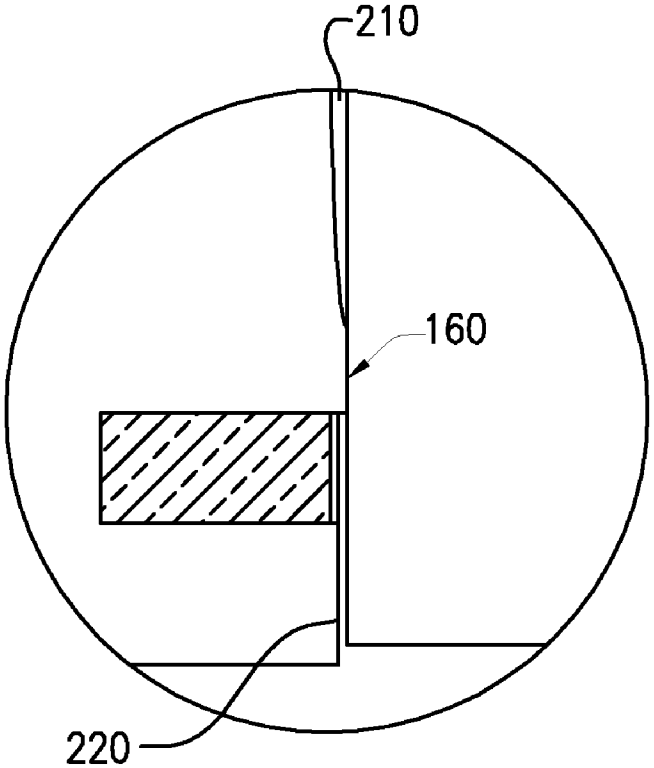
FIG. 3B is an expanded view of the encircled portion of FIG. 3A.
Figure 3A:
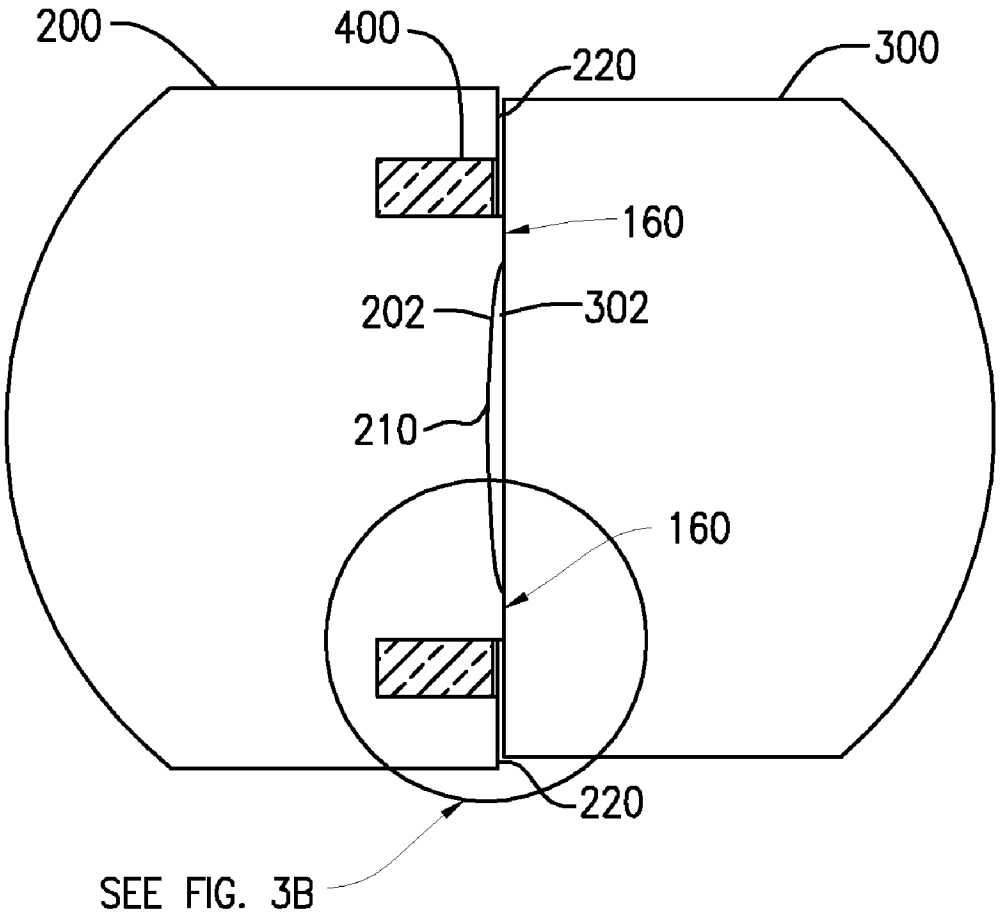
FIG. 3A is a sectional view of a portion of a solenoid including a core with a surface relief, in accordance with an embodiment of the present invention.

FIG. 3 is a sectional view of a portion of a solenoid including a core 200 with various surface modifications placed adjacent a plunger 300 having a flat junction surface 302. Core 200 includes junction surface 202 that may include center relief 210 and/or perimeter relief 220. Combining center relief 210 and perimeter relief 220 provides a contact region 160 having a limited annular range. Relief 220 may provide a gap of about 0.002 inches between the core 200 and the plunger 300. However, in other embodiments, the gap provided by relief 220 may be greater than or less than 0.002 inches.

The embodiment of FIG. 3, which includes a core 200 with relief gaps 210, 220 in combination with a flat-surfaced plunger 300, may beneficially avoid a need for double-end machining of the plunger 300. While FIG. 3 shows one shape of center relief 210, alternative elliptical shaped reliefs 210 may be employed. Moreover, reliefs having various other alternative shapes may be employed without departing from the scope of the present invention.

Figure 4:
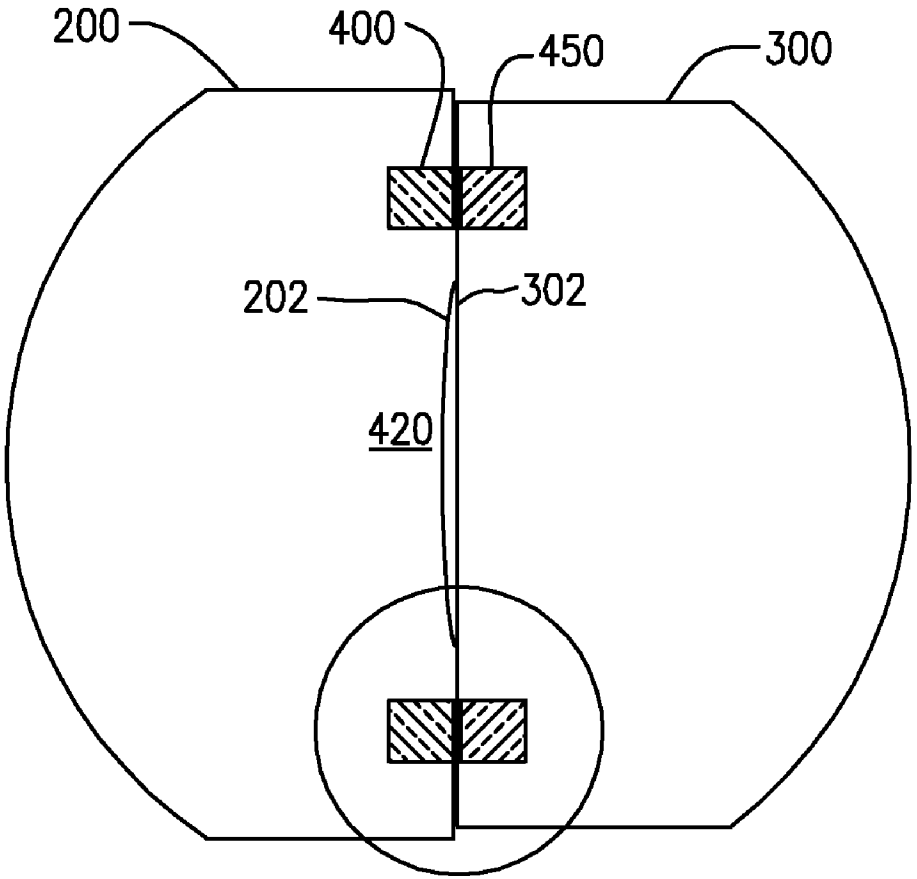
FIG. 4 is a sectional view of a portion of a solenoid having an extra shading ring, in accordance with an embodiment of the present invention.

FIG. 4 shows an alternative embodiment in which core 200 includes a first shading ring 400, and a second shading ring 450 is located within plunger 300. In this embodiment, the shading ring effect can be increased by embedding the second shading ring 450 in plunger 300. Second shading ring 450 serves as a second winding and therefore increases the magnetic flux in the region of central pole 420. It will be recalled that the region of central pole 420 extends throughout the region within the internal diameter of shading ring 400. Moreover, second shading ring 450 is positioned so that the interface between the plunger 200 and core 300 surfaces 202, 302 is between the two shading rings which would be the position of maximum flux intensity when using shading ring 400 and shading ring 450.

The embodiment of FIG. 4 may allow the amount of material in the shading rings 400, 450 to be decreased which would in turn reduce the cost of each shading ring as well as reduce the difficulty and cost of making the grooves for housing shading rings 400 and 450.

The reduction in the cost of the rings 400, 450 and of making the grooves for rings 400, 450 may at least partially offset the increases in cost associated with the extra shading ring, thereby resulting in a minimal extra cost for the embodiment as a whole. The resulting operational benefits are expected to be well worth the minimal net extra cost.

Figure 5:
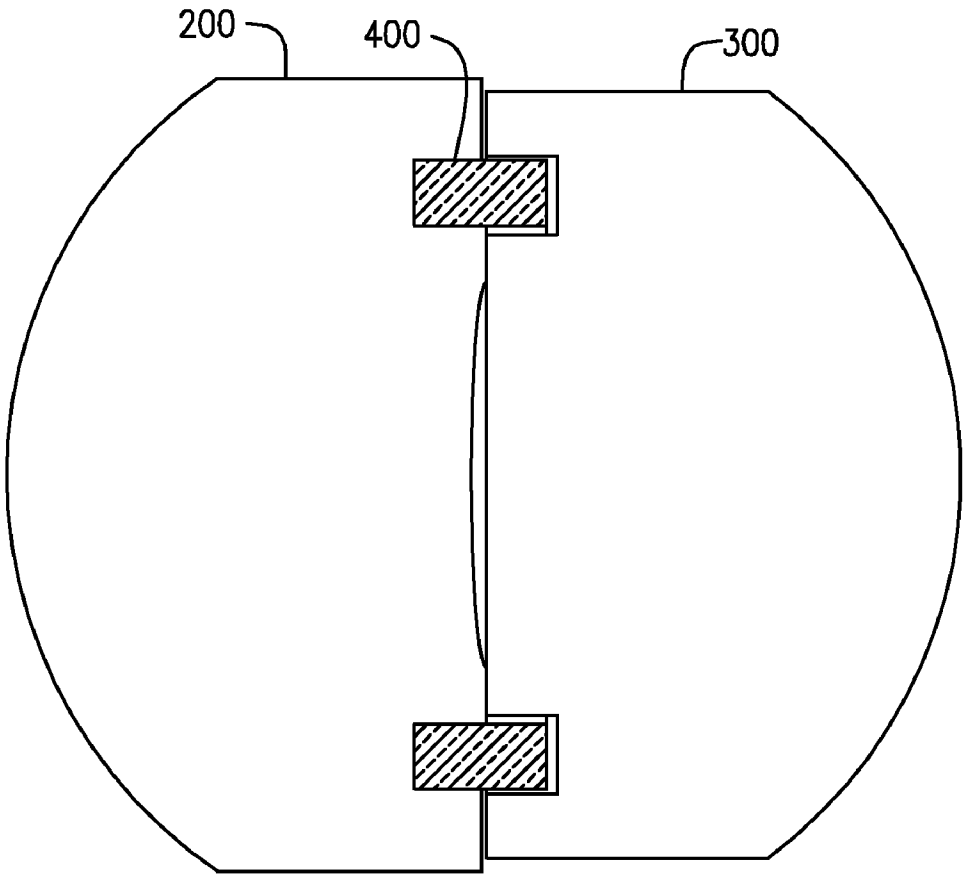
FIG. 5 is a sectional view of a portion of a solenoid, showing a shading ring housed within both a core and a plunger, in accordance with an embodiment of the present invention.

FIG. 5 shows an embodiment in which shading ring 400 is housed partially in core 200 and partially in plunger 300. Preferably, suitable recesses are provided in core 200 and plunger 300 to house the respective portions of shading ring 400 to be received therein.

In this embodiment, shallower grooving in both the core 200 and the plunger 300 may be employed for receiving the shading ring 400. Shading ring 400 may be fixed to one of core 200 and plunger 300 and have ample clearance in the other of the two parts.

Deploying shading ring 400 in this manner may increase the intensity of the magnetic flux at the interface of core 200 and plunger 300 and thereby increase the effectiveness of shading ring 400. In alternative embodiments, the shading ring 400 may be fixed to one of the plunger 300 and the core 200, to both the plunger 300 and the core 200, or to neither the core 200 nor the plunger 300. If the shading ring 400 is not fixed to either the plunger 300 or the core 200, the shading ring 400 may nevertheless be securely lodged between the plunger 300 and the core 200 during an assembly process, to ensure proper operation thereof, once assembly is complete.

Figure 6:
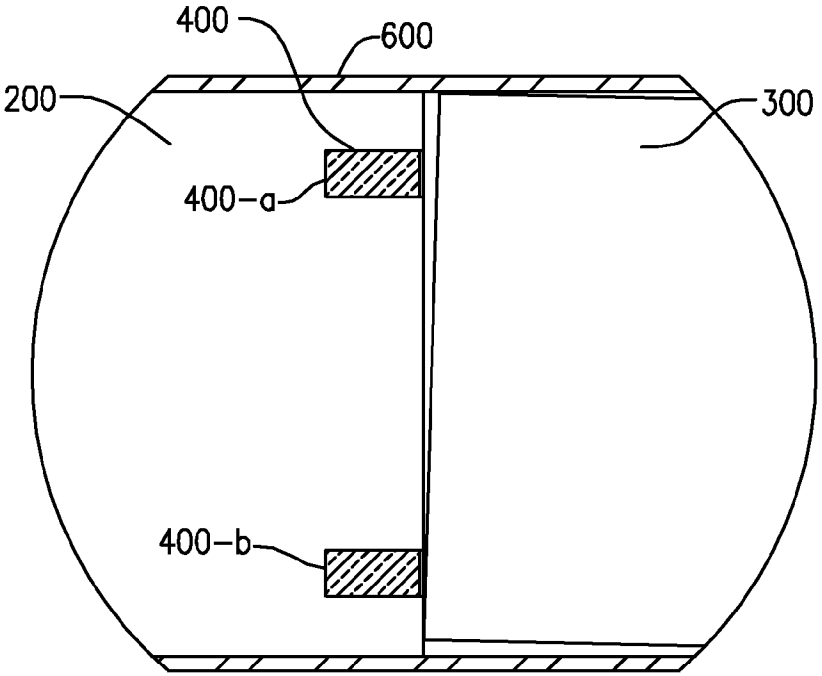
FIG. 6 is a sectional view of a core and a misaligned plunger of a solenoid of the prior art.

FIG. 6 shows a core 200 and plunger 300 disposed within a guide tube 600 of the prior art. FIG. 6 shows the effect of a misalignment of about 1.1 degrees between the mating surfaces of the core 200 and the plunger 300, with the axis of this misalignment at a point along the perimeter of plunger 300. Though guide tube 600 may limit the misalignment, the misalignment nevertheless results in a gap of about 0.002 inches at a portion 400-*b* of shading ring 400 closest to the axis of the misalignment, and in a gap of about 0.006 inches at a portion 400-*a* farthest from the axis of the misalignment.

The above-described gaps substantially reduce the permeability of the parts in the shading ring 400 magnetic circuit. The resulting reduction in magnetic attraction force between the core 200 and the plunger 300 allows the return spring (not shown) to pull the plunger 300 away from the core 200 which in turn causes vibration and associated buzzing noise to occur within the solenoid. If the misalignment and junction surface separation was caused by the presence of debris or by damage to one or more of the surfaces in the form of a dent, then the plunger 300 will be unstable and may also vibrate transversely, thereby adding to the noise. If the junction surfaces (mating surfaces) of the plunger 300 and core 200 are not manufactured within tight flatness tolerances, the plunger 300 may be unstable about a one or more points of contact between the junction surfaces.

Figure 7:
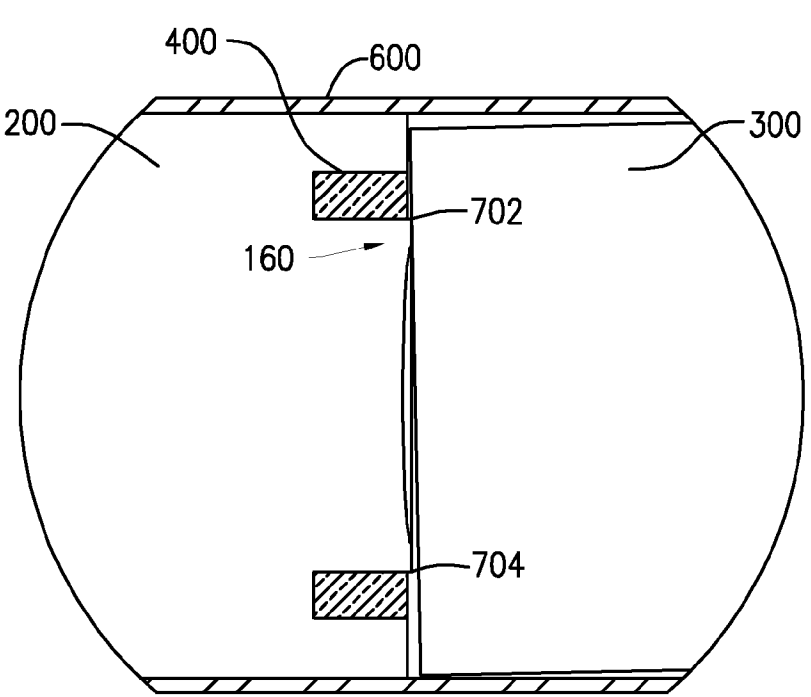
FIG. 7 is a sectional view of a core and a misaligned plunger of a solenoid, in accordance with an embodiment of the present invention.

FIG. 7 shows a misalignment between the junction surfaces of the core 200 and the plunger 300 occurring in a device in accordance with an embodiment of the present invention. The misalignment of FIG. 7 is about 1.1 degrees as was shown for the prior art device of FIG. 6. However, because of the effectiveness of annular contact region 160 between core 200 and plunger 300, some intimate contact between core 200 and plunger 300 within the central pole area of the core 200 is maintained.

Thus, when sufficient magnetic attraction force is present, the annular contact surface of plunger 300 will preferably always have some intimate contact with the high flux concentration zone of the central pole area of the core 200, even in the presence of misalignment between the core 200 and plunger 300 occurring within the constraints imposed by the guide tube 600. This intimate contact, even if only a small edge spot, preferably changes the shape and location of the gap caused by the misalignment. The contact occurring at contact region 160 also preferably increases the permeability of the parts in the magnetic circuit as compared to that created by the misaligned flat-surfaced plunger of FIG. 6. The increase in permeability thereby increases the magnetic force binding plunger 300 to core 200 imparted by shading ring 400, and thereby attenuates the excessive buzzing that may be present in a similarly misaligned plunger of the prior art.

Hardened ferric material can become permanently magnetized, and very soft ferric material cannot. This property of soft ferric material is used in solenoids because the magnetic force needs to be removed when the solenoid is de-energized for the solenoid to operate properly. In fast-acting mechanisms, a rapid removal of magnetic force is needed. However, in applications where there is no need for high actuation speed, a slower reduction or removal of the magnetic force can be tolerated.

The availability of a slow removal of magnetic force is relevant to an embodiment of the present invention. This is because a slower collapse of the magnetic force may aid in preventing buzzing noise. This indicates that careful tuning of the hardness of the core 200 and plunger 300 can create a condition where there is sufficient residual magnetic force to prevent the return spring 500 from pulling the plunger 300 away from the core 200 during the short, AC-induced periods of low magnetic force, and yet have a sufficient magnetic-force collapse rate to allow the return spring to pull the plunger away from the core sufficiently soon after the solenoid is de-energized.

The ability to adjust the hardness of the core 200 and plunger 300 materials benefits from careful control not only in the material manufacturing process, but in the tracking of inventory. Preferably, the material, the hardness of which is to be accurately adjusted, is precisely identified and carefully monitored throughout the handling of such material in the inventorying and shipping processes. Upon successfully achieving desired hardness characteristics for the plunger 300 and core 200, elimination of the shading ring may become possible.

Figure 8:
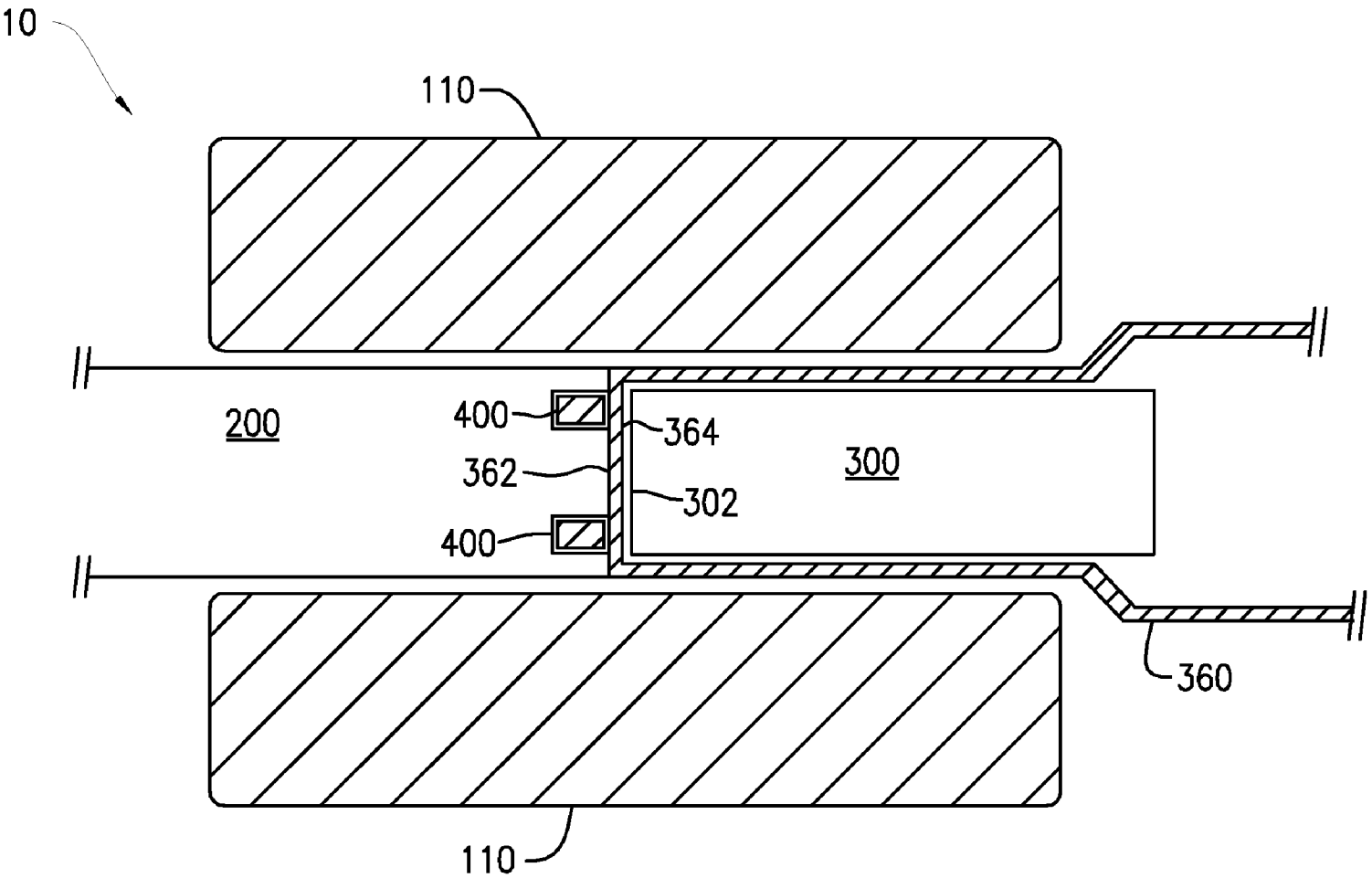
FIG. 8 is a sectional view of a portion of a solenoid assembly including a plunger pot configured to secure the shading ring in place even when the plunger is withdrawn, in accordance with an embodiment of the invention.

FIG. 8 shows a portion of a solenoid 10 assembly including a plunger pot 360 in accordance with one embodiment of the invention. Solenoid 10 may include winding 110, core 200, plunger 300, shading ring 400, and plunger pot 360 which may include plunger pot wall 362.

In this embodiment, plunger 300 is encased within a plunger pot 360 and thus does not directly contact core 200. Plunger pot 360 preferably remains immobile with respect to core 200, while plunger 300 moves back and forth within plunger pot 360 upon the activation and de-activation of power to solenoid 10.

One benefit of this arrangement is that shading ring 400 is preferably permanently secured between plunger pot wall 362 and core 200. Thus, even when plunger 300 is withdrawn from contact with plunger pot wall 362, such as upon de-activation of solenoid 10, shading ring 400 remains securely fixed between plunger pot wall 362 and core 200. This arrangement precludes any possibility of shading ring 400 being dislodged from core 200 upon the rightward movement of plunger 300.

The surface geometries of surfaces 202 and 302 described in connection with the various embodiments herein that were implemented in order to concentrate magnetic force within a contact region 160 may be practiced using the embodiment of FIG. 8. However, in this embodiment, the pertinent interface is between the rightmost surface 364 (the plunger pot wall junction surface) of plunger pot wall 362 and plunger junction surface 302.

Figure 9:
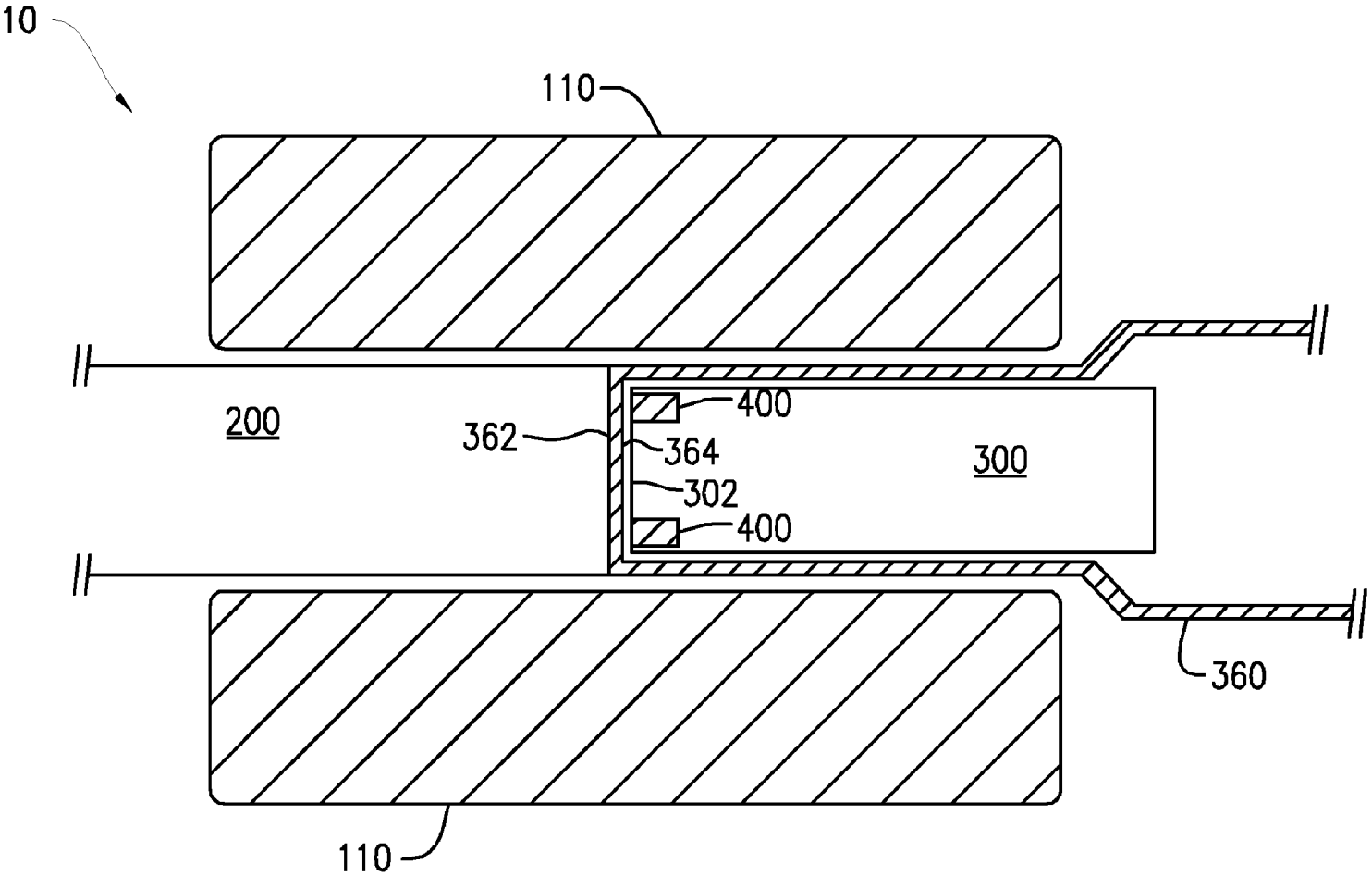
FIG. 9 is a sectional view of a portion of a solenoid assembly including a plunger pot and a shading ring embedded within a plunger operable to move within the plunger pot in accordance with an embodiment of the invention.

FIG. 9 is a sectional view of a portion of a solenoid assembly including a plunger pot and a shading ring embedded within a plunger operable to move within the plunger pot in accordance with an embodiment of the invention. In this embodiment, as with that of FIG. 8, plunger 300 is encased within plunger pot 360, and thus does not directly contact core 200. Plunger pot 360 preferably remains immobile with respect to core 200, while plunger 300 is preferably operable to move back and forth within plunger pot 360 upon the activation and de-activation of power to solenoid 10. In the embodiment of FIG. 9, shading ring 400 is preferably embedded within plunger 300.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A solenoid comprising:

a core having a junction surface;

a plunger having a junction surface and located proximate to the core;

a shading ring located proximate to an interface between the core junction surface and the plunger junction surface, the shading ring having an outside diameter slightly smaller than the diameter of the core, and operable to produce a concentration of magnetic attraction within an annular range of the interface between a center of the interface and a location of the shading ring;

wherein one of the core junction surface or the plunger junction surface is substantially flat and the other of the core junction surface or the plunger junction surface has a concavity formed therein such that an annular contact region is formed at the interface between the core junction surface and the plunger junction surface which is substantially smaller than the respective junction surfaces and is located proximate to the annular range of the concentration of magnetic attraction.

2. The solenoid of claim 1 wherein the contact region is arranged so as to conform substantially to the annular range of the concentration of magnetic attraction.

3. The solenoid of claim 1 wherein the concavity is conical and the junction surface having the concavity formed therein optionally further comprises a relief along a periphery of the junction surface.

4. The solenoid of claim 1 wherein the plunger junction surface is substantially flat and the core junction surface has at least one of:

a) a concave shape with a relief at a center thereof; and b) a relief along a periphery thereof.

5. The solenoid of claim 2 wherein the contact region between the respective junction surfaces is located over an annular region of the interface between the respective junction surfaces, wherein the annular contact region has a center radius slightly smaller than a radial position of an inner diameter of the shading ring.

6. The solenoid of claim 1 wherein the shading ring is embedded within the core.

7. The solenoid of claim 1 wherein the shading ring is embedded within the plunger.

8. The solenoid of claim 1 wherein the shading ring is embedded at least partially within the core and at least partially within the plunger.

9. The solenoid of claim 1 comprising two shading rings, the first shading ring being disposed in the core and the second shading ring being disposed in the plunger.

10. A solenoid comprising:

a core assembly fixed within the solenoid and having a junction surface;

a plunger moveable within the solenoid and having a junction surface;

a shading ring located proximate to an interface between the core assembly junction surface and the plunger junction surface, the shading ring having an outside diameter slightly smaller than the diameter of the core and operable to produce a concentration of magnetic attraction at the interface between the plunger junction surface and the core assembly junction surface within an annular range of the interface between a center of the interface and a radial position of an inner diameter of the shading ring;

wherein one of the core junction surface or the plunger junction surface is substantially flat and substantially perpendicular to an adjoining side surface thereof and the other of the core junction surface or the plunger junction surface has a conical concavity formed therein such that when the respective junction surfaces are contacted, an annular contact region is formed at the interface such that the contact region between the plunger junction surface and the core assembly junction surface is substantially smaller than the respective junction surfaces and located proximate to the annular range of the concentration of magnetic attraction.

11. The solenoid of claim 10 wherein the shading ring is embedded within the plunger.

12. The solenoid of claim 10 wherein the shading ring is embedded within the core.

13. The solenoid of claim 10 wherein the core assembly comprises substantially only a core and the core assembly junction surface is a core junction surface.

* * * * *